US005657393A

United States Patent [19]

Crow

[11] Patent Number: 5,657,393

[45] Date of Patent: Aug. 12, 1997

[54] BEAMED LINEAR ARRAY MICROPHONE SYSTEM

[76] Inventor: Robert P. Crow, 4725 Bywood Ct., Colorado Springs, Colo. 80906

[21] Appl. No.: 99,437

[22] Filed: Jul. 30, 1993

[51] Int. Cl.[6] ..... H04R 3/00

[52] U.S. Cl. ..... 381/92; 367/123; 367/125; 367/126

[58] Field of Search ..... 381/92, 94, 155; 367/123, 124, 125, 126

[56] References Cited

U.S. PATENT DOCUMENTS

| | | | |
|---|---|---|---|
| 4,170,766 | 10/1979 | Pridham et al. | 367/123 |
| 4,311,874 | 1/1982 | Wallace, Jr. | 381/92 |
| 4,421,957 | 12/1983 | Wallace, Jr. . | |
| 4,521,908 | 6/1985 | Miyaji et al. | 381/92 |
| 4,696,043 | 9/1987 | Iwahara et al. | 381/92 |
| 4,955,003 | 9/1990 | Goldman | 367/125 |

FOREIGN PATENT DOCUMENTS

| | | | |
|---|---|---|---|
| 3-278799 | 12/1991 | Japan | 381/155 |

OTHER PUBLICATIONS

Alvarado, Victor M. and Silverman, Harvey F., "Experimental Results Showing The Effects of Optimal Spacing Between Element of a Linear Microphone Array," IEEE, Feb. 1990. CH 2847-2/90/0000-0837.

*Primary Examiner*—Forester W. Isen

[57] ABSTRACT

A sound enhancement system including a beamed linear array microphone system for the acoustic pickup of voice and music from substantial distances with a relatively narrow sound pickup beam and with the avoidance of acoustic feedback. The acceptance beam angle is relatively constant over the desired sound octaves. Response outside of the acceptance beam is relatively low. The system includes a microprocessor-controlled circuit for processing the signals from a multiplicity of microphone elements in the linear array for application to a loudspeaker.

13 Claims, 10 Drawing Sheets

MICROPHONE ELEMENT SPACING IN PARTIAL ARRAY

MICROPHONE ELEMENT SPACING IN HALF ARRAY

LINEAR ARRAY RESPONSE CHARACTERISTICS $F = 1.25\ 10^3$ $S = 0.35$ $D = 40$ $v = 0$ $\phi = 90$

LINEAR ARRAY RESPONSE CHARACTERISTICS $F = 1.25\ 10^3$ $S = 0.35$ $D = 40$ $v = 0$ $\phi = 90$

LINEAR ARRAY RESPONSE CHARACTERISTICS $F = 1.25\ 10^3$ $S = 0.35$ $D = 40$ $v = 0$ $\phi = 75$

LINEAR ARRAY RESPONSE CHARACTERISTICS $F = 1.25\ 10^3$ $S = 0.35$ $D = 40$ $v = 0$ $\phi = 90$

LINEAR ARRAY RESPONSE CHARACTERISTICS

F = 625 S = 0.35 D = 40 v = 0 $\phi$ = 90

LINEAR ARRAY RESPONSE CHARACTERISTICS

F = 625 S = 0.7 D = 40 v = 0 $\phi$ = 90

BEAMED LINEAR ARRAY MICROPHONE SYSTEM

BACKGROUND OF THE INVENTION

The invention provides a beamed linear array microphone system for the acoustic pickup of voice and music from substantial distances with a relatively narrow pickup-beam and with the avoidance of acoustical feedback. Response of the system within the pick-up beam is relatively constant over the several normal sound octaves, and response outside of the beam is relatively low, with the acceptance angle of the beam likewise being relatively constant over the several normal sound octaves.

The system of the invention has particular utility for sound enhancement in auditoriums, studios, music halls and other facilities. The linear microphone array of the system may be mounted on or near the ceiling of the auditorium at a remote position from the stage, or other source of sound. An important feature of the system is that it provides a means for sound reinforcement throughout the hall without acoustical feedback.

There are a variety of microphone arrays which are capable of providing a narrow beam response, including, for example, planar or circular arrays. However, a linear "end-fire" array is presently preferred in the system of the invention because of its economy of microphone elements and associated electronics.

DETAILED DESCRIPTION OF THE ILLUSTRATED EMBODIMENT

Figure 1:
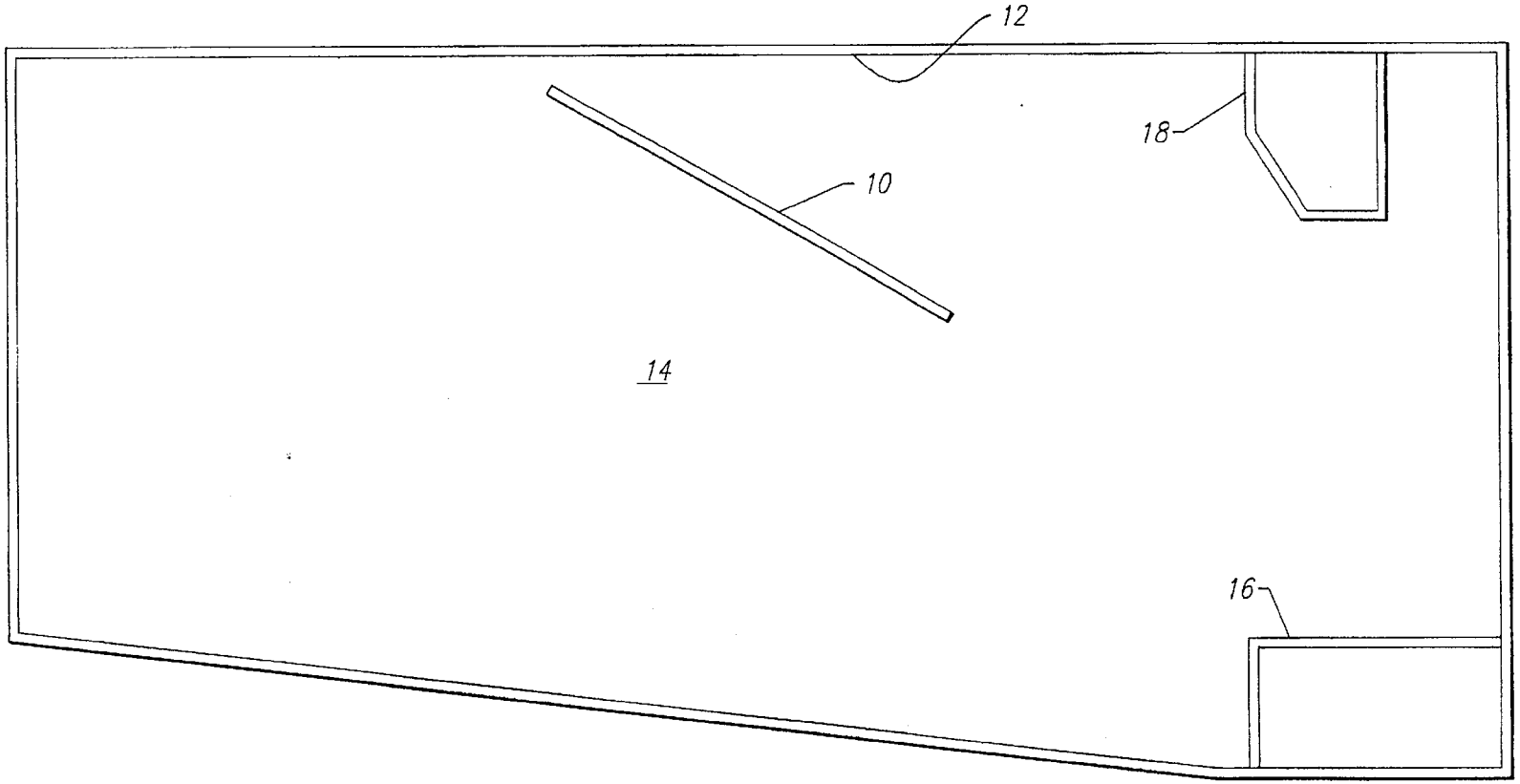
FIG. 1 is a somewhat schematic representation of a side view of a typical auditorium with a microphone array installed for inclusion in the system of the invention in one of its embodiments.

As shown in FIG. 1, the linear microphone array 10 of the invention is mounted adjacent to the ceiling 12 of an auditorium 14; and the array points toward a stage 16, or other sound source. The array 10, in appearance, will be similar to a long rod, with its sound pick-up beam in line with the longitudinal axis of the rod. No appreciable sound response exists to the rear of the rod, or at any angle to the rod out of the beam. A typical public address loudspeaker 18 is mounted near the ceiling 12, as shown, and it provides sound reinforcement coverage for the entire auditorium.

Figure 2A:
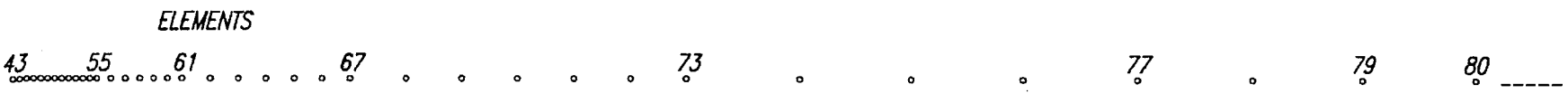
FIG. 2A is a schematic representation showing the microphone element spacings along a single linear axis in a partial array in the system of the invention and which responds to various frequency ranges throughout the normal sound octaves to be sensed and amplified by the system.

FIG. 2A shows some of the microphone elements 43–80 which are included in the linear array 10 of FIG. 1. These microphone elements, for example, may be a small commercially available type, such as the Shure Brothers WL83.

Figure 2B:
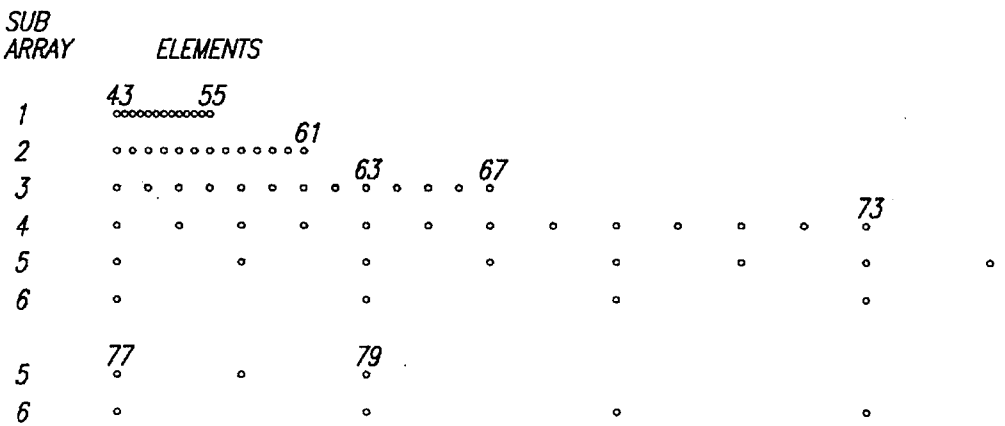
FIG. 2B is a schematic representation of the microphone element spacings in half an array in the system of the invention, and with the microphones for the various frequency ranges being displaced from one another by predetermined distances, and the microphones in the different sub-arrays or different frequency ranges being shown as displaced from the normal linear axis of the array, only for purposes of illustration and description it being understood that all the microphones in the array are positioned on a single linear axis.

As shown in FIG. 2B, and in the following Table A, there are six sub-arrays provided to cover a frequency range of 156 Hz to 10 kHz with each sub-array covering one octave, and with a predetermined microphone spacing in each of the sub-arrays.

TABLE A

Sub-Array Ranges and Microphone Elements

| Sub Array | Frequency Range | Microphone Elements |
|---|---|---|
| 1 | 5 kHz–10 kHz | 31.32.33.34 - - - 41.42.43.44.45.46 - - - 53.54.55 |
| 2 | 2.5 kHz–5 kHz | 25–31.33.35.37.39.41.43.45.47.49.51.53.55–61 |
| 3 | 1250 Hz–2.5 kHz | 19–25.27.29.31.35.39.43.47.51.55.57.59.61–67 |
| 4 | 625 Hz–1250 Hz | 13–19.21.23.27.31.35.43.51.57.61.63.65.67–73 |
| 5 | 312 Hz–625 Hz | 7–13.15.17.19.23.29.43.57.63.67.69.71.73–79 |
| 6 | 156 Hz–312 Hz | 1 - - - 7.9.11.13.17.23.43.63.69.73.75.77.79–85 |

In the embodiment under consideration, there are twenty-five microphone elements in each sub-array. Only microphone elements 43–85 are shown in FIG. 2B. Microphone elements 1–42 (not shown) extend to the left of FIG. 2B. An examination of FIG. 2B will reveal that many of the microphone elements may be used in common in the various sub-arrays. This common usage of the microphone elements serves to reduce the number required, for example, from one hundred fifty to eighty-five in the illustrated embodiment. The microphone elements used in each sub-array are listed in Table A. It will be noted that sub-array 6, which covers the lowest frequency octave, and which is at least twice as long as the other sub-arrays, has microphone elements over the entire range from 1–85.

Each of the microphone elements of the array produces an output signal proportional to the instantaneous acoustic sound pressure imposed on each of the microphone elements, which changes in accordance with the frequency or frequencies of the sound signal source. In order to form a sound pick-up beam, the signal phase from each of the microphone elements must be coincident at the center of the beam. This means that a suitable time delay must be provided to each microphone channel to compensate for the difference in distance, and propagation delay, from the sound source at 16 to each microphone element. In the illustrated embodiment with the end-fire microphone array 10 of FIG. 1, and with the beam center extending along the longitudinal axis of the array, the time delays of each microphone element relate directly to the microphone element spacings in the array. Therefore, if microphone element 1 is closest to the sound source at 16, the channel of microphone element 2 requires a lesser time delay equivalent to the spacing between the two microphone elements 1 and 2.

Figure 3:
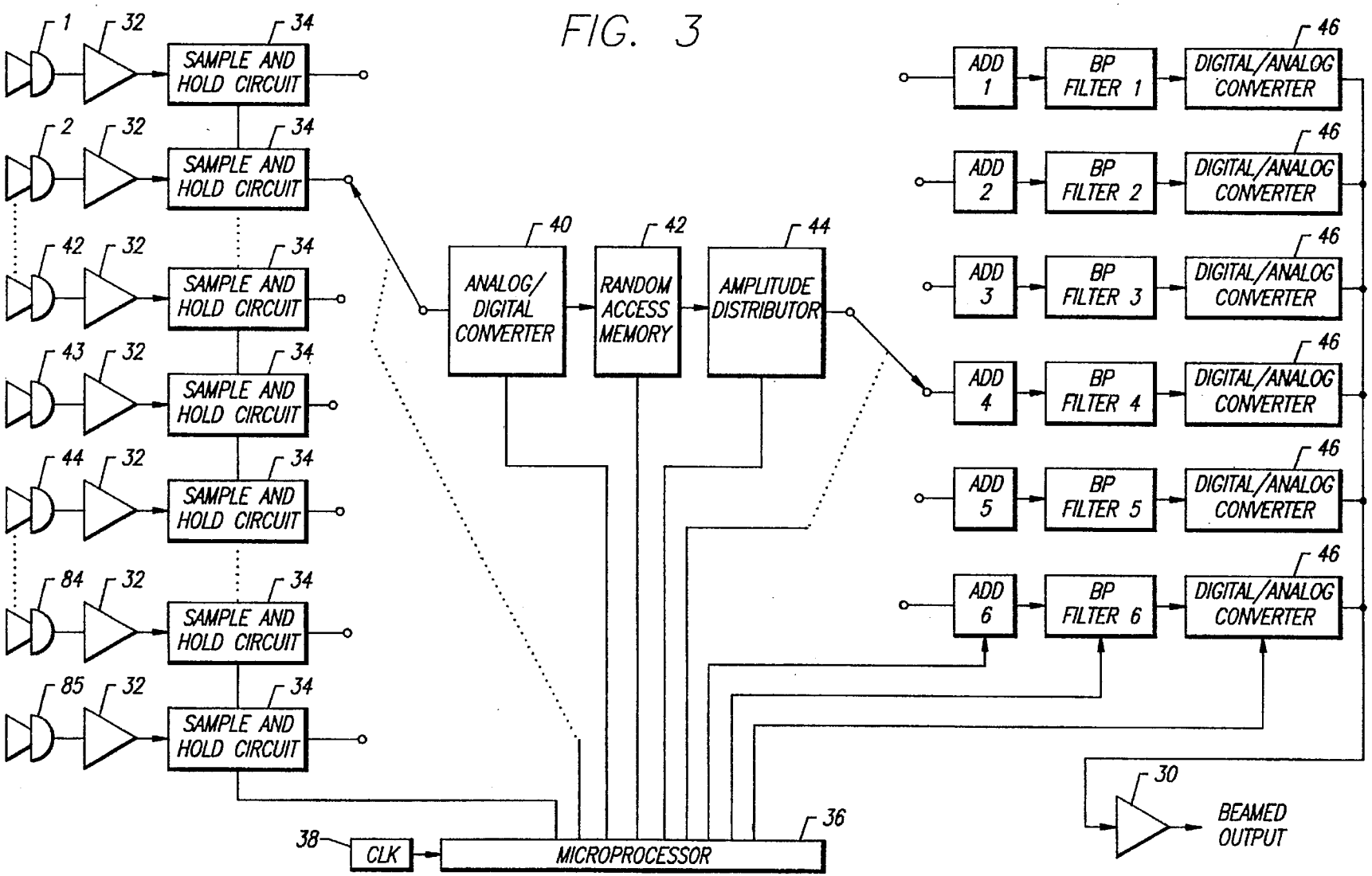
FIG. 3 is a block diagram of a linear microphone array system in accordance with one embodiment of the invention.

FIG. 3 is a block diagram of the system of the invention in one of its embodiments and illustrates the basic sequential switching functions exerted on the output signals from the microphone elements 1–85 prior to their application to to an output amplifier 30. Output amplifier 30 drives the loudspeaker 18 of FIG. 1. A microprocessor 36 controls all the functions of the system under the control of a conventional clock circuit 38. In FIG. 3. The output of each of the microphone elements 1–85 is amplified in a corresponding preamplifier 32 and fed to a corresponding sample-and-hold circuit 34. Sampling is initiated by microprocessor 36, and it occurs simultaneously for all of the microphone elements 1–85. The sampling rate, must be at least two times the maximum frequency, for example 40 kHz.

The samples stored in the sample-and-hold circuits 34 are selected sequentially by microprocessor 36 and fed to an analog/digital converter 40 in which they are converted to corresponding digital signals. The digitized samples from converter 40 are stored in a random access memory (RAM) 42. This memory also serves to provide the variable delay required by each microphone element for beam forming, as discussed above. Such delay is accomplished by reading the samples of the different microphone elements from the memory at different subsequent sampling periods in accordance with the desired delays.

The twenty-five samples of sub-array 1, for example, are read from memory with the desired delays. An amplitude distributor circuit 44 receives the outputs of sub-array 1 and modifies their digitized amplitudes in accordance with a Taylor, or similar distribution factor to substantially reduce the beam sidelobe levels. The digital signals of sub-array 1 are then fed to a summing network designated "Add 1" in which they are summed to provide a beam output for the 5 kHz to 10 kHz frequency range of sub-array 1. The digital output is then processed in a digital band-pass filter designated "BP Filter 1" to attenuate any frequency components below and above the 5 kHz to 10 kHz range of sub-array 1 in order to suppress acoustic feedback. The filtering occurs over a number of sampling periods, depending on the signal frequency. The output is then applied to a digital-analog converter 46 in which it is converted to analog form to provide the analog sub-array 1 output, which is applied to amplifier 30.

The same procedure as described in the preceding paragraph is utilized for the samples of sub-arrays 2–6. All six sub-array outputs are combined and amplified for the array system output from amplifier 30. Microprocessor 36 (FIG. 3) performs all the control and processing operations of the signals from microphone elements 1–85, in the manner described above. It should be noted that the time delays for each of the microphone channels in a sub-array include any difference in delay of the sub-array bandpass filters, so that the total delays following the filters are equal. For example, the lowest frequency, and narrowest bandpass filter (156–312 Hz) has a longer dela than the highest frequency bandpass filter (5–10 kHz), and as a consequence all microphone channels of this latter sub-array 1 will have a longer delay than for sub-array 6.

It should be pointed out that all of the components of the system of FIG. 3 shown in block form are standard commercial elements, which are readily available. For that reason, it is believed unnecessary for the clear understanding of the present invention to show and describe the various components in circuit detail.

Figure 4:
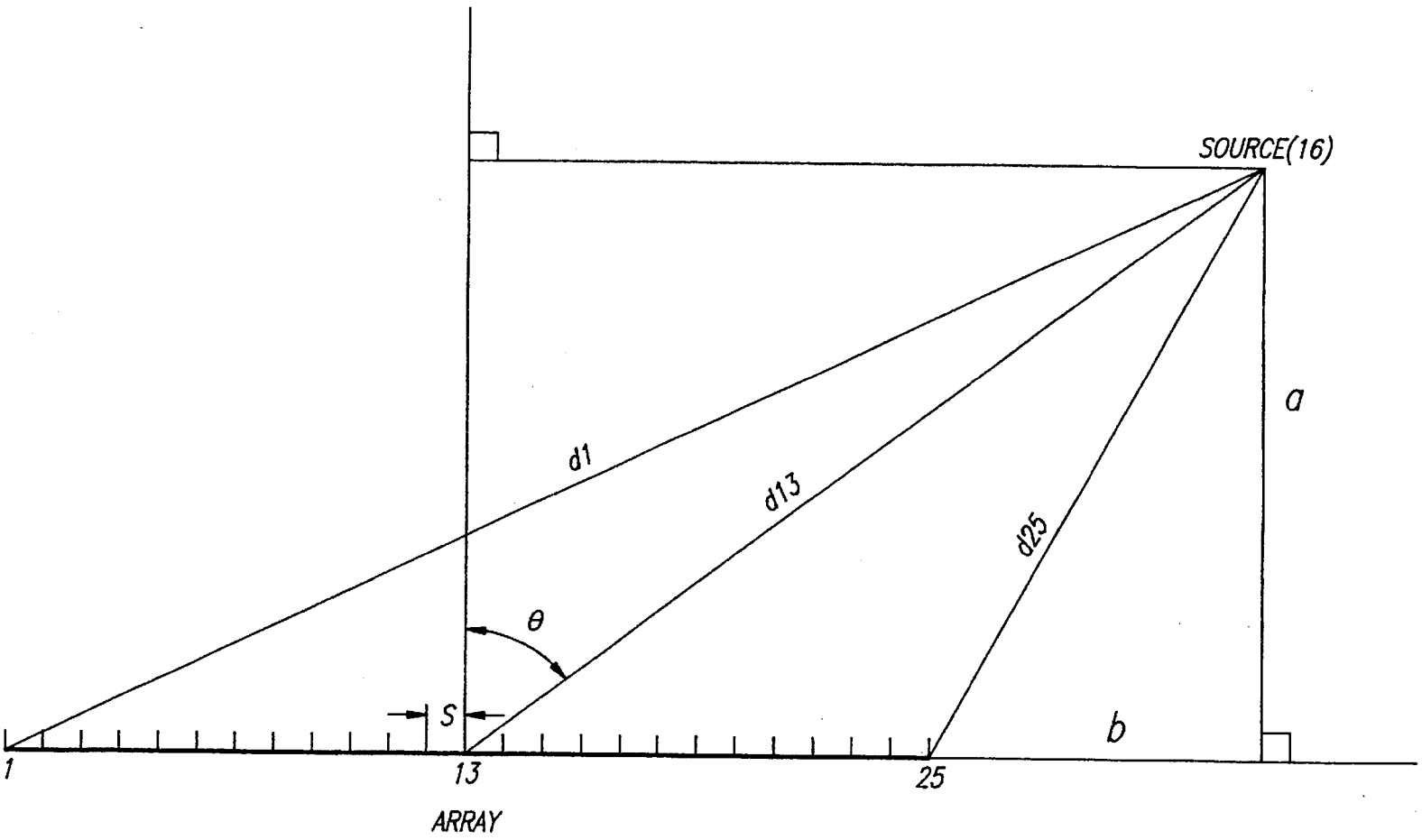
FIG. 4 is a graphic representation representing the distances of the various sub-array microphone elements in the system from the sound source.

FIG. 4 illustrates the distance relations between the microphone elements of the array and a sound source of a selected sub-array in a simulated system. The sub-array elements are evenly spaced along the array length. Vectors "a" and "b" vary as a function of the angle with respect to the array for a given distance D, between the array center d13 and the sound source. It is noted that, for convenience, the angle θ is referenced from the perpendicular to the array axis, the array beam center (ϕ of FIG. 3) is then at 90 degrees. The term "s" represents the element-to-element spacing of a sub-array. The parameters for the distances d1–d25 of a sub-array can be determined from FIG. 4.

Table B lists the various parameters and equations for determining the plot of the beam characteristics. This table, along with the various parameters and their definitions, lists the distance equations d1–d25, using the relations of FIG. 4. Each of the distance equations represents that of a sub-array microphone. The term P is a fixed constant (0.4 in this case) used to determine the microphone spacing S. The value of P provides a balance between sidelobe level and acceptance beamwidth for a given array length. The term "v" represents the vertical offset distance of the array axis and the source. This term is normally set to zero if the array is pointing at the sound source, as is the case in FIG. 1. The first square root term in each of the equations determines distance over the range of angle θ, and the second term provides for the distance related time delay for each element at a fixed beam angle ϕ. Each of the distance equations (d1 to d25) represents that of a sub-array microphone. Each microphone output voltage and the phase of its output voltage are represented by the quatrature "x" and "y" terms in their "Taylor" distribution multipliers (0.057–1.00). These are summed as "xs" and "ys" terms, and the sub-array output voltage "e" is determined by the square root of the sum of the squares of xs and ys. The output voltage e is for a defined angle theta, and for a particular sub-array with its element spacing, s, (i.e., spacing between adjacent microphone acoustic phase centers) and frequency. Response at any other frequency can be determined with the corresponding sub-array and element spacing.

TABLE B

This is an angular response analysis of a linear end-fire microphone array of 25 elements with a sound source at a finite distance.

| | |
|---|---|
| $\theta := 0.1\ 180$ | Horizontal angle from array center forward to source, deg. |
| $\phi = 90$ | Beam angle from array center to source, degrees. |
| $D := 40$ | Horizontal distance, sound source to center element, ft. |
| $v := 0$ | Vertical distance, array to source, ft. |
| $F := 1250$ | Frequency, Hertz |
| $W := \frac{1100}{F}$ | Sound wavelength, ft. $W = 0.88$ |
| $P := 0.4$ | Portion of wavelength at max array frequency equal to array element spacing. |
| $S := P \cdot W$ | Array element spacing, ft. $S = 0.35$ |
| $L = 24 \cdot S$ | Array length, ft. $L = 8.45$ |

TABLE B-continued $deg = \frac{\pi}{180}$ Degrees to radians conversion $a_\theta := D \cdot \cos(\theta\ deg)$ $b_\theta := D \cdot \sin(\theta \cdot deg) - 12 \cdot S$ $m := D \cdot \cos(\phi \cdot deg)$ $n := D \cdot \sin(\phi \cdot deg) - 12 \cdot S$ $d1_\theta = \sqrt{[v^2 + (a_\theta)^2 + (b_\theta + 24 \cdot S)^2]} - \sqrt{[v^2 + m^2 + (n + 24 \cdot S)^2]}$ $d2_\theta = \sqrt{[v^2 + (a_\theta)^2 + (b_\theta + 23 \cdot S)^2]} - \sqrt{[v^2 + m^2 + (n + 23 \cdot S)^2]}$ $d3_\theta := \sqrt{[v^2 + (a_\theta)^2 + (b_\theta + 22 \cdot S)^2]} - \sqrt{[v^2 + m^2 + (n + 22 \cdot S)^2]}$ $d4_\theta := \sqrt{[v^2 + (a_\theta)^2 + (b_\theta + 21 \cdot S)^2]} - \sqrt{[v^2 + m^2 + (n + 21 \cdot S)^2]}$ $d5_\theta := \sqrt{[v^2 + (a_\theta)^2 + (b_\theta + 20 \cdot S)^2]} - \sqrt{[v^2 + m^2 + (n + 20 \cdot S)^2]}$ $d6_\theta := \sqrt{[v^2 + (a_\theta)^2 + (b_\theta + 19 \cdot S)^2]} - \sqrt{[v^2 + m^2 + (n + 19 \cdot S)^2]}$ $d7_\theta := \sqrt{[v^2 + (a_\theta)^2 + (b_\theta + 18 \cdot S)^2]} - \sqrt{[v^2 + m^2 + (n + 18 \cdot S)^2]}$ $d8_\theta := \sqrt{[v^2 + (a_\theta)^2 + (b_\theta + 17 \cdot S)^2]} - \sqrt{[v^2 + m^2 + (n + 17 \cdot S)^2]}$ $d9_\theta = \sqrt{[v^2 + (a_\theta)^2 + (b_\theta + 16 \cdot S)^2]} - \sqrt{[v^2 + m^2 + (n + 16 \cdot S)^2]}$ $d10_\theta = \sqrt{[v^2 + (a_\theta)^2 + (b_\theta + 15 \cdot S)^2]} - \sqrt{[v^2 + m^2 + (n + 15 \cdot S)^2]}$ $d11_\theta := \sqrt{[v^2 + (a_\theta)^2 + (b_\theta + 14 \cdot S)^2]} - \sqrt{[v^2 + m^2 + (n + 14 \cdot S)^2]}$ $d12_\theta := \sqrt{[v^2 + (a_\theta)^2 + (b_\theta + 13 \cdot S)^2]} - \sqrt{[v^2 + m^2 + (n + 13 \cdot S)^2]}$ $d13_\theta := \sqrt{[v^2 + (a_\theta)^2 + (b_\theta + 12 \cdot S)^2]} - \sqrt{[v^2 + m^2 + (n + 12 \cdot S)^2]}$ $d14_\theta := \sqrt{[v^2 + (a_\theta)^2 + (b_\theta + 11 \cdot S)^2]} - \sqrt{[v^2 + m^2 + (n + 11 \cdot S)^2]}$ $d15_\theta := \sqrt{[v^2 + (a_\theta)^2 + (b_\theta + 10 \cdot S)^2]} - \sqrt{[v^2 + m^2 + (n + 10 \cdot S)^2]}$ $d16_\theta := \sqrt{[v^2 + (a_\theta)^2 + (b_\theta + 9 \cdot S)^2]} - \sqrt{[v^2 + m^2 + (n + 9 \cdot S)^2]}$ $d17_\theta = \sqrt{[v^2 + (a_\theta)^2 + (b_\theta + 8 \cdot S)^2]} - \sqrt{[v^2 + m^2 + (n + 8 \cdot S)^2]}$ $d18_\theta = \sqrt{[v^2 + (a_\theta)^2 + (b_\theta + 7 \cdot S)^2]} - \sqrt{[v^2 + m^2 + (n + 7 \cdot S)^2]}$ $d19_\theta := \sqrt{[v^2 + (a_\theta)^2 + (b_\theta + 6 \cdot S)^2]} - \sqrt{[v^2 + m^2 + (n + 6 \cdot S)^2]}$ $d20_\theta := \sqrt{[v^2 + (a_\theta)^2 + (b_\theta + 5 \cdot S)^2]} - \sqrt{[v^2 + m^2 + (n + 5 \cdot S)^2]}$ $d21_\theta := \sqrt{[v^2 + (a_\theta)^2 + (b_\theta + 4 \cdot S)^2]} - \sqrt{[v^2 + m^2 + (n + 4 \cdot S)^2]}$ $d22_\theta := \sqrt{[v^2 + (a_\theta)^2 + (b_\theta + 3 \cdot S)^2]} - \sqrt{[v^2 + m^2 + (n + 3 \cdot S)^2]}$ $d23_\theta := \sqrt{[v^2 + (a_\theta)^2 + (b_\theta + 2 \cdot S)^2]} - \sqrt{[v^2 + m^2 + (n + 2 \cdot S)^2]}$ $d24_\theta := \sqrt{[v^2 + (a_\theta)^2 + (b_\theta + 1 \cdot S)^2]} - \sqrt{[v^2 + m^2 + (n + 1 \cdot S)^2]}$ $d25_\theta := \sqrt{[v^2 + (a_\theta)^2 + (b_\theta + 0 \cdot S)^2]} - \sqrt{[v^2 + m^2 + (n + 0 \cdot S)^2]}$

TABLE C $x1_\theta := \cos\left(\frac{d1_\theta}{W} \cdot 2 \cdot \pi\right) \cdot .057$ $x2_\theta := \cos\left(\frac{d2_\theta}{W} \cdot 2 \cdot \pi\right) \cdot .086$ $x3_\theta := \cos\left(\frac{d3_\theta}{W} \cdot 2 \cdot \pi\right) \cdot .140$ $x4_\theta := \cos\left(\frac{d4_\theta}{W} \cdot 2 \cdot \pi\right) \cdot .217$ $x5_\theta := \cos\left(\frac{d5_\theta}{W} \cdot 2 \cdot \pi\right) \cdot .314$ $x6_\theta := \cos\left(\frac{d6_\theta}{W} \cdot 2 \cdot \pi\right) \cdot .429$ $x7_\theta := \cos\left(\frac{d7_\theta}{W} \cdot 2 \cdot \pi\right) \cdot .543$ $x8_\theta := \cos\left(\frac{d8_\theta}{W} \cdot 2 \cdot \pi\right) \cdot .669$ $x9_\theta := \cos\left(\frac{d9_\theta}{W} \cdot 2 \cdot \pi\right) \cdot .777$ $x10_\theta := \cos\left(\frac{d10_\theta}{W} \cdot 2 \cdot \pi\right) \cdot .877$ $x11_\theta := \cos\left(\frac{d11_\theta}{W} \cdot 2 \cdot \pi\right) \cdot .949$ $x12_\theta := \cos\left(\frac{d12_\theta}{W} \cdot 2 \cdot \pi\right) \cdot .991$ $x13_\theta := \cos\left(\frac{d13_\theta}{W} \cdot 2 \cdot \pi\right) \cdot 1.00$ $x14_\theta := \cos\left(\frac{d14_\theta}{W} \cdot 2 \cdot \pi\right) \cdot .991$ $x15_\theta := \cos\left(\frac{d15_\theta}{W} \cdot 2 \cdot \pi\right) \cdot .949$ $x16_\theta := \cos\left(\frac{d16_\theta}{W} \cdot 2 \cdot \pi\right) \cdot .877$ $x17_\theta := \cos\left(\frac{d17_\theta}{W} \cdot 2 \cdot \pi\right) \cdot .777$ $x18_\theta := \cos\left(\frac{d18_\theta}{W} \cdot 2 \cdot \pi\right) \cdot .669$ $x19_\theta := \cos\left(\frac{d19_\theta}{W} \cdot 2 \cdot \pi\right) \cdot .543$ $x20_\theta := \cos\left(\frac{d20_\theta}{W} \cdot 2 \cdot \pi\right) \cdot .429$ $x21_\theta := \cos\left(\frac{d21_\theta}{W} \cdot 2 \cdot \pi\right) \cdot .314$ $x22_\theta := \cos\left(\frac{d22_\theta}{W} \cdot 2 \cdot \pi\right) \cdot .217$ $x23_\theta := \cos\left(\frac{d23_\theta}{W} \cdot 2 \cdot \pi\right) \cdot .140$ $x24_\theta := \cos\left(\frac{d24_\theta}{W} \cdot 2 \cdot \pi\right) \cdot .086$ $x25_\theta := \cos\left(\frac{d25_\theta}{W} \cdot 2 \cdot \pi\right) \cdot .057$ $y1_\theta := \sin\left(\frac{d1_\theta}{W} \cdot 2 \cdot \pi\right) \cdot .057$ $y2_\theta := \sin\left(\frac{d2_\theta}{W} \cdot 2 \cdot \pi\right) \cdot .086$ $y3_\theta := \sin\left(\frac{d3_\theta}{W} \cdot 2 \cdot \pi\right) \cdot .140$ $y4_\theta := \sin\left(\frac{d4_\theta}{W} \cdot 2 \cdot \pi\right) \cdot .217$ $y5_\theta := \sin\left(\frac{d5_\theta}{W} \cdot 2 \cdot \pi\right) \cdot .314$ $y6_\theta := \sin\left(\frac{d6_\theta}{W} \cdot 2 \cdot \pi\right) \cdot .429$ $y7_\theta := \sin\left(\frac{d7_\theta}{W} \cdot 2 \cdot \pi\right) \cdot .543$ $y8_\theta := \sin\left(\frac{d8_\theta}{W} \cdot 2 \cdot \pi\right) \cdot .669$ $y9_\theta := \sin\left(\frac{d9_\theta}{W} \cdot 2 \cdot \pi\right) \cdot .777$ $y10_\theta := \sin\left(\frac{d10_\theta}{W} \cdot 2 \cdot \pi\right) \cdot .877$ $y11_\theta := \sin\left(\frac{d11_\theta}{W} \cdot 2 \cdot \pi\right) \cdot .949$ $y12_\theta := \sin\left(\frac{d12_\theta}{W} \cdot 2 \cdot \pi\right) \cdot .991$ TABLE C-continued $$y13_\theta := \sin\left(\frac{d13_\theta}{W}\cdot 2\cdot\pi\right)\cdot 1.00 \quad y14_\theta := \sin\left(\frac{d14_\theta}{W}\cdot 2\cdot\pi\right)\cdot .991 \quad y15_\theta := \sin\left(\frac{d15_\theta}{W}\cdot 2\cdot\pi\right)\cdot .949 \quad y16_\theta := \sin\left(\frac{d16_\theta}{W}\cdot 2\cdot\pi\right)\cdot .877$$

$$y17_\theta := \sin\left(\frac{d17_\theta}{W}\cdot 2\cdot\pi\right)\cdot .777 \quad y18_\theta := \sin\left(\frac{d18_\theta}{W}\cdot 2\cdot\pi\right)\cdot .669 \quad y19_\theta := \sin\left(\frac{d19_\theta}{W}\cdot 2\cdot\pi\right)\cdot .543 \quad y20_\theta := \sin\left(\frac{d20_\theta}{W}\cdot 2\cdot\pi\right)\cdot .429$$

$$y21_\theta := \sin\left(\frac{d21_\theta}{W}\cdot 2\cdot\pi\right)\cdot .314 \quad y22_\theta := \sin\left(\frac{d22_\theta}{W}\cdot 2\cdot\pi\right)\cdot .217 \quad y23_\theta := \sin\left(\frac{d23_\theta}{W}\cdot 2\cdot\pi\right)\cdot .140 \quad y24_\theta := \sin\left(\frac{d24_\theta}{W}\cdot 2\cdot\pi\right)\cdot .086$$

$$y25_\theta := \sin\left(\frac{d25_\theta}{W}\cdot 2\cdot\pi\right)\cdot .057$$

$$xs_\theta := x1_\theta + x2_\theta + x3_\theta + x4_\theta + x5_\theta + x6_\theta + x7_\theta + x8_\theta + x9_\theta + x10_\theta + x11_\theta + x12_\theta + x13_\theta + x14_\theta + x15_\theta + x16_\theta + x17_\theta + x18_\theta + x19_\theta \ldots + x20_\theta + x21_\theta + x22_\theta + x23_\theta + x24_\theta + x25_\theta$$

$$ys_\theta := y1_\theta + y2_\theta + y3_\theta + y4_\theta + y5_\theta + y6_\theta + y7_\theta + y8_\theta + y9_\theta + y10_\theta + y11_\theta + y12_\theta + y13_\theta + y14_\theta + y15_\theta + y16_\theta + y17_\theta + y18_\theta + y19_\theta \ldots + y20_\theta + y21_\theta + y22_\theta + y23_\theta + y24_\theta + y25_\theta$$

$$\text{WRITE(xslow)} := xs1_\theta \qquad \text{WRITE(yslow)} := ys1_\theta$$

$$xs1_\theta := \text{READ(xslow)} \qquad ys1_\theta := \text{READ(yslow)}$$

$$e_\theta := \sqrt{[(.0\cdot xs1_\theta) + 1\cdot xs_\theta]^2 + (.0\cdot ys1_\theta + 1\cdot ys_\theta)^2} \qquad edB_\theta := 20\cdot\log\left(\frac{e_\theta}{13.27}\right)$$

Table C lists the x and y phase coordinate terms for each element as a function of the distance and wavelength. There is also a multiplier term for each element, a Taylor amplitude distribution term, (0.057 to 1.00) for the case shown will suppress the sidelobes some 46 dB or greater. The x and y terms are separately summed for each value of θ in Table C. The sub-array output $e_\theta$ is determined by taking the square root of the sum of $x_\theta$ and $y_\theta$ squares. The relative output in dB, $edB_\theta$, is also shown on the bottom of Table C.

Figure 5A:
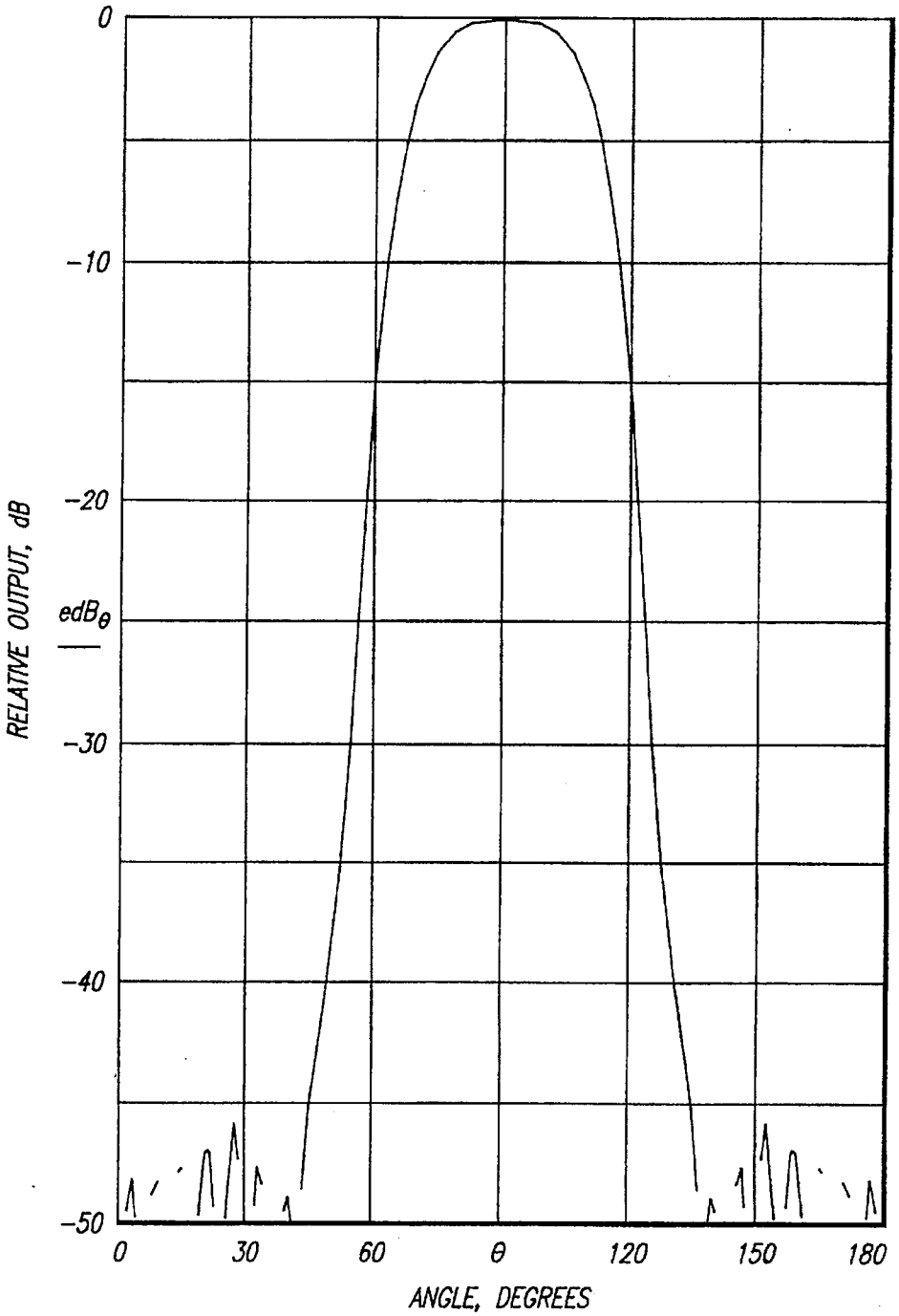
FIG. 5A is a curve representing the response characteristics of the linear microphone array in the system.
Figure 5B:
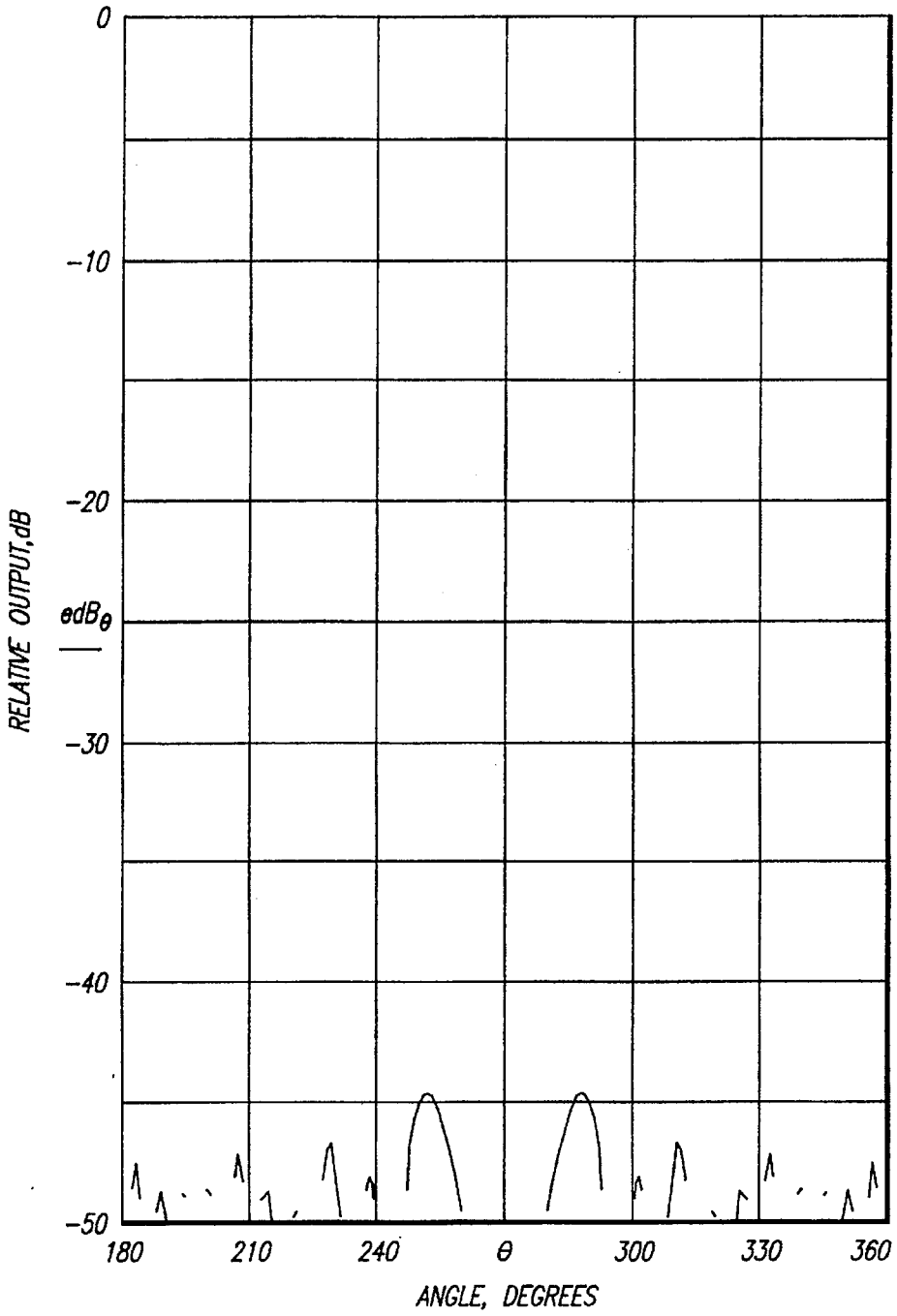
FIG. 5B are further curves representing the linear microphone array response characteristics.
Figure 6:
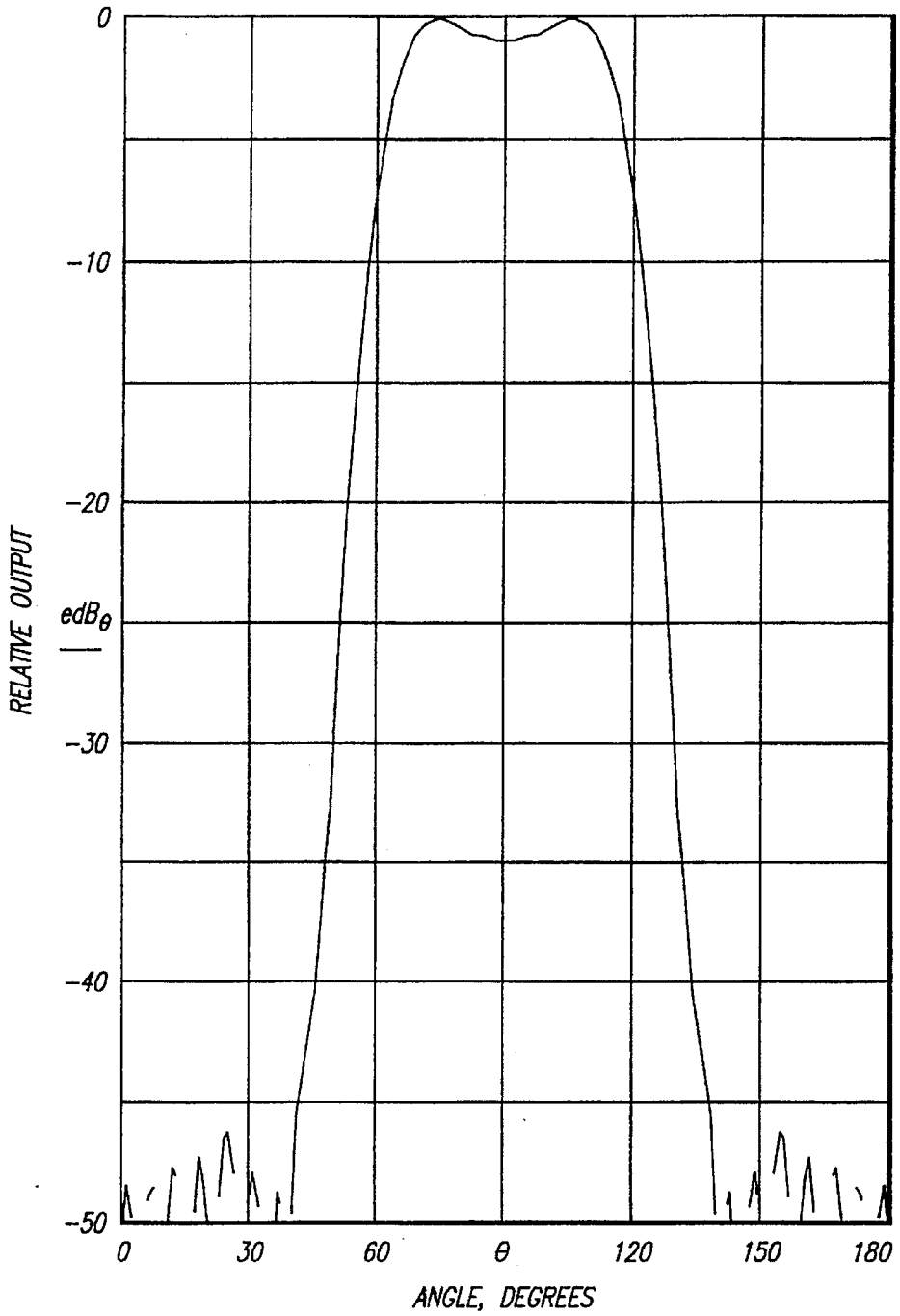
FIGS. 6, 7A, 7B and 8 are further curves representing the response characteristics of the linear microphone array in the system of the invention.

FIG. 5A shows the resulting array angular response plot at 1250 Hz±90 degrees from the beam center. The 3 dB beam width is approximately ±21 degrees, and the 40 dB beam width is ±43 degrees. FIG. 5B shows the very low response of the array in the rear 180 degrees. FIG. 6 illustrates how the beam may be broadened to a degree by setting the beam angle, with associated element delays to 75 degrees.

Figure 7A:
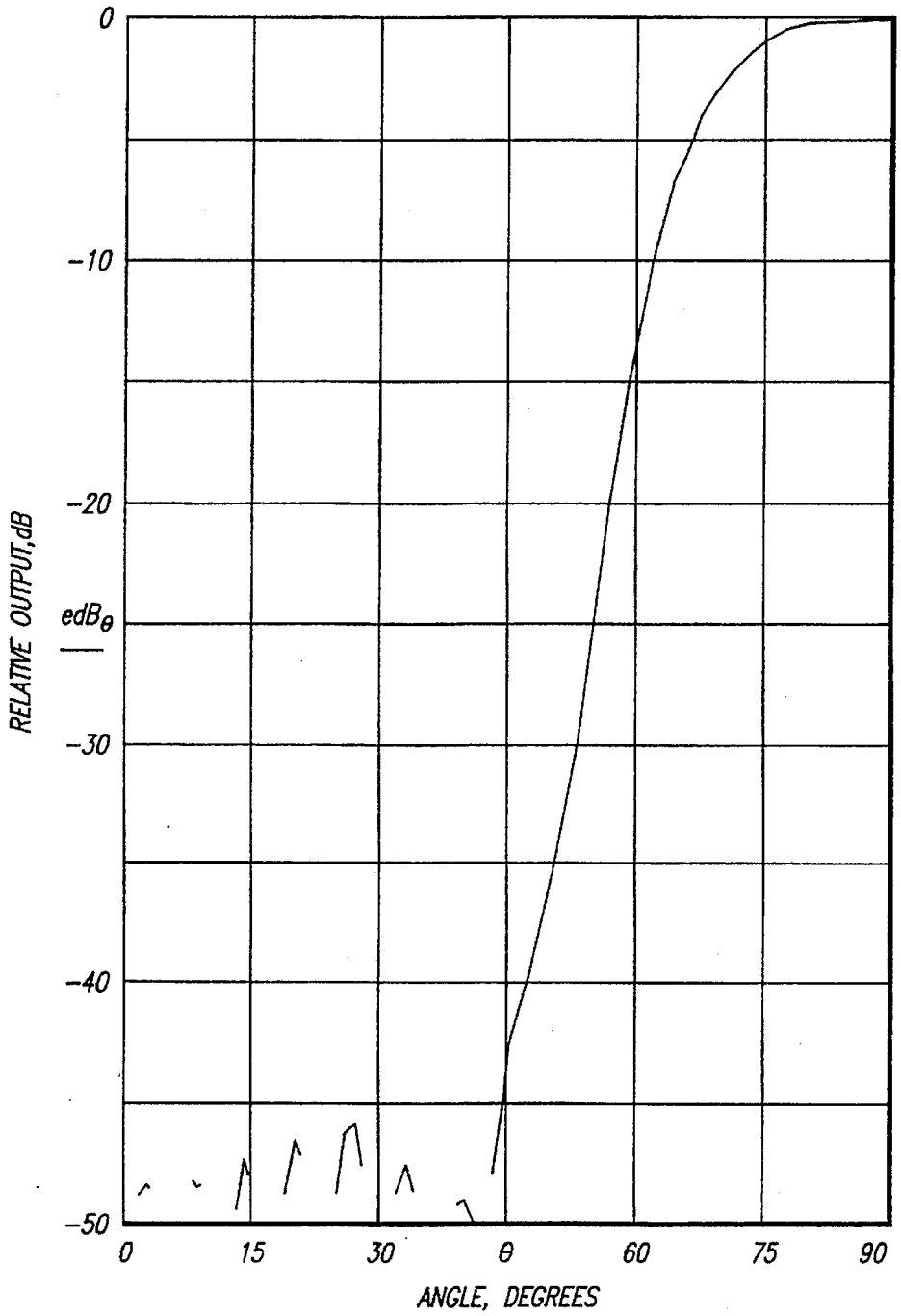
Figure 7B:
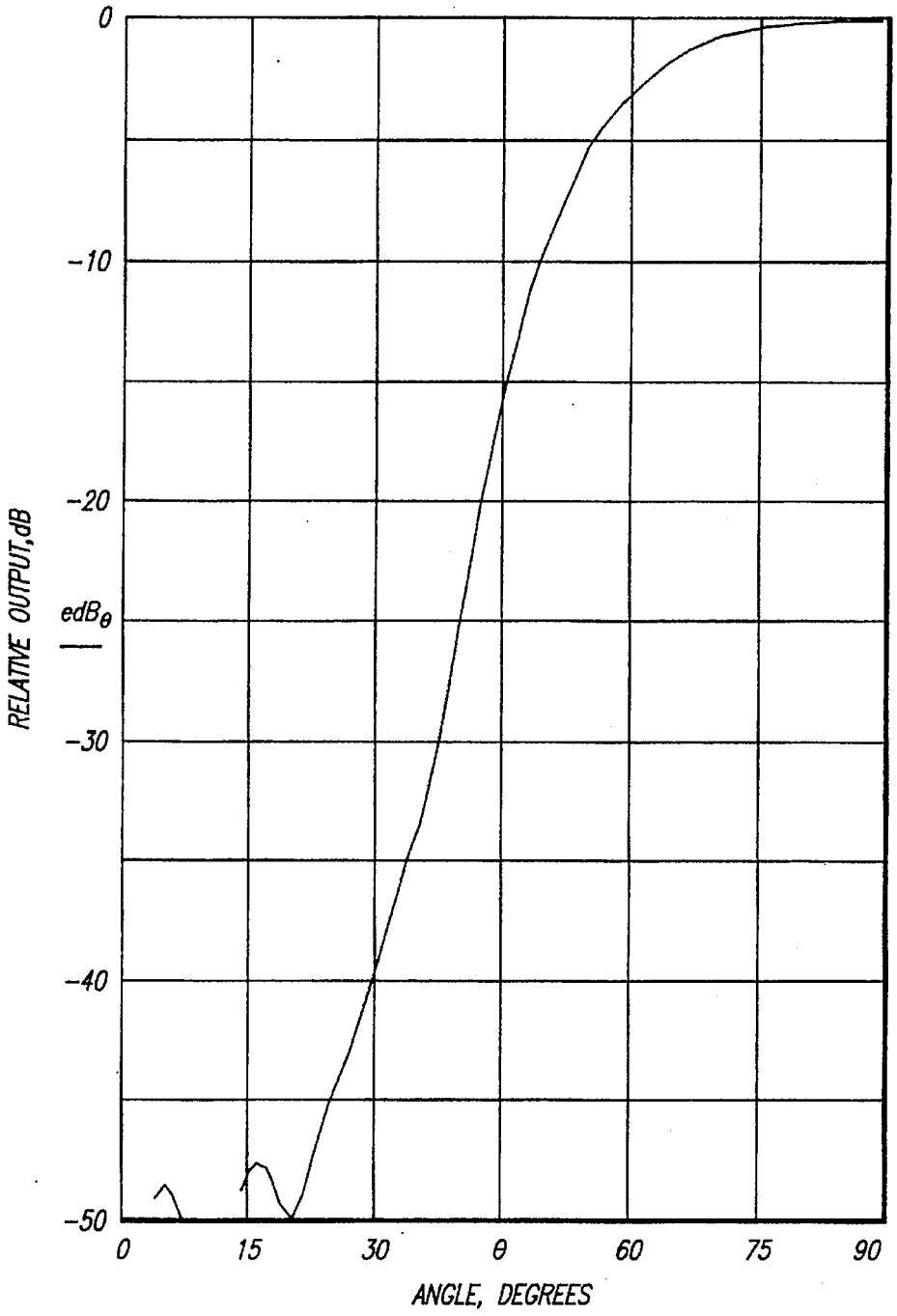

The beam width across each sub-array frequency band increases toward the low end of the band. This is because the element spacing, determined at the top end of the band, remains constant, leaving fewer wave lengths of aperture at the lower end of the band. However, there is a response overlap of the sub-array bandpass filters, and when the outputs of the adjacent sub-arrays are added the effect is to narrow the beam at the low end of the band and broaden the beam at the upper end of the band. This causes the beam widths to become equal. Depending on the sharpness of the filter cut-offs, the beam widths may be fairly constant over each sub-array band, and over the whole array band. FIGS. 7A and 7B illustrate that effect. FIG. 7A shows the one-half beam width at 1250 Hz, as in FIG. 5A; and FIG. 7B shows the broader beam width at 625 Hz at the low end of the band of the same sub-array.

Table D shows further calculations with respect to those shown in Table B with modified calculation of $e_\theta$. Data for $xs_\theta$ and $ys_\theta$ at 625 Hz is stored as $xs1_\theta$ and $ys1_\theta$ and added to the data taken at the top end of the sub-array 5 at the same frequency, both at half value.

Figure 8:
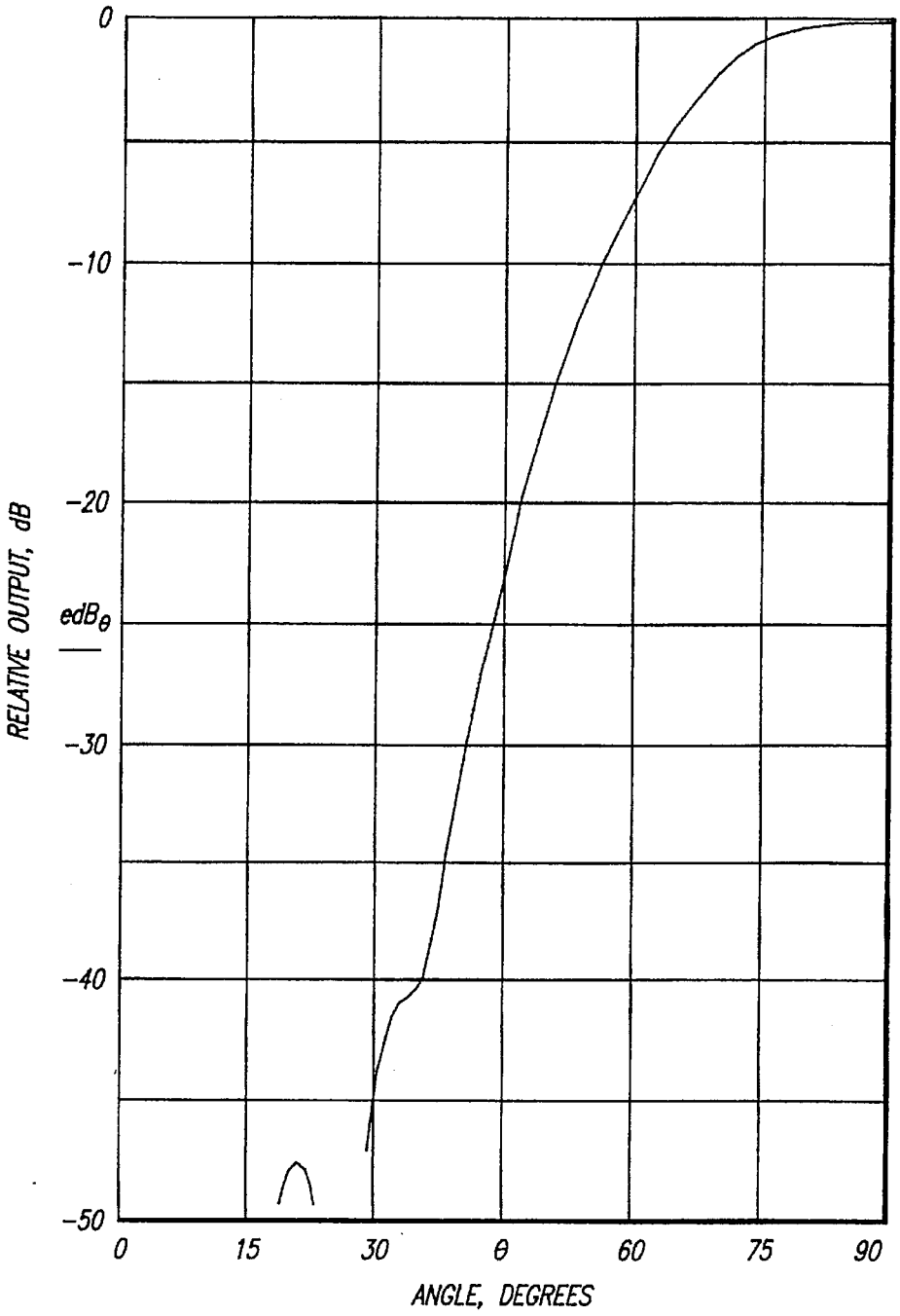

FIG. 8 shows the resulting half-beam plot. Note that the beam width lies between those of FIGS. 7A and 7B. It can also be shown that the beam width at 1250 Hz, when added to the low end of the sub-array 3, produces the same beam width as at 625 Hz. The beam width at the low end of sub-array 6, 156 Hz will be equivalent to that shown in FIG. 7B.

One of the factors of concern in an auditorium with sound reinforcement is the isolation between the microphone and the loudspeaker which limits the acoustic gain that can be utilized before acoustic feedback occurs. The following Table E shows an analysis which indicates that with the very low array sidelobes it is possible to provide sound levels throughout a typical auditorium equivalent to that at 6 feet from the sound source with approximately 20 dB feedback margin.

TABLE D $$x1_\theta := \cos\left(\frac{d1_\theta}{W}\cdot 2\cdot\pi\right)\cdot .057 \quad x2_\theta := \cos\left(\frac{d2_\theta}{W}\cdot 2\cdot\pi\right)\cdot .086 \quad x3_\theta := \cos\left(\frac{d3_\theta}{W}\cdot 2\cdot\pi\right)\cdot .140 \quad x4_\theta := \cos\left(\frac{d4_\theta}{W}\cdot 2\cdot\pi\right)\cdot .217$$

$$x5_\theta := \cos\left(\frac{d5_\theta}{W}\cdot 2\cdot\pi\right)\cdot .314 \quad x6_\theta := \cos\left(\frac{d6_\theta}{W}\cdot 2\cdot\pi\right)\cdot .429 \quad x7_\theta := \cos\left(\frac{d7_\theta}{W}\cdot 2\cdot\pi\right)\cdot .543 \quad x8_\theta := \cos\left(\frac{d8_\theta}{W}\cdot 2\cdot\pi\right)\cdot .669$$

$$x9_\theta := \cos\left(\frac{d9_\theta}{W}\cdot 2\cdot\pi\right)\cdot .777 \quad x10_\theta := \cos\left(\frac{d10_\theta}{W}\cdot 2\cdot\pi\right)\cdot .877 \quad x11_\theta := \cos\left(\frac{d11_\theta}{W}\cdot 2\cdot\pi\right)\cdot .949 \quad x12_\theta := \cos\left(\frac{d12_\theta}{W}\cdot 2\cdot\pi\right)\cdot .991$$

$$x13_\theta := \cos\left(\frac{d13_\theta}{W}\cdot 2\cdot\pi\right)\cdot 1.00 \quad x14_\theta := \cos\left(\frac{d14_\theta}{W}\cdot 2\cdot\pi\right)\cdot .991 \quad x15_\theta := \cos\left(\frac{d15_\theta}{W}\cdot 2\cdot\pi\right)\cdot .949 \quad x16_\theta := \cos\left(\frac{d16_\theta}{W}\cdot 2\cdot\pi\right)\cdot .877$$

TABLE D-continued $x17_\theta := \cos\left(\frac{d17_\theta}{W} \cdot 2 \cdot \pi\right) \cdot .777$ $x18_\theta := \cos\left(\frac{d18_\theta}{W} \cdot 2 \cdot \pi\right) \cdot .669$ $x19_\theta := \cos\left(\frac{d19_\theta}{W} \cdot 2 \cdot \pi\right) \cdot .543$ $x20_\theta := \cos\left(\frac{d20_\theta}{W} \cdot 2 \cdot \pi\right) \cdot .429$ $x21_\theta := \cos\left(\frac{d21_\theta}{W} \cdot 2 \cdot \pi\right) \cdot .314$ $x22_\theta := \cos\left(\frac{d22_\theta}{W} \cdot 2 \cdot \pi\right) \cdot .217$ $x23_\theta := \cos\left(\frac{d23_\theta}{W} \cdot 2 \cdot \pi\right) \cdot .140$ $x24_\theta := \cos\left(\frac{d24_\theta}{W} \cdot 2 \cdot \pi\right) \cdot .086$ $x25_\theta := \cos\left(\frac{d25_\theta}{W} \cdot 2 \cdot \pi\right) \cdot .057$ $y1_\theta := \sin\left(\frac{d1_\theta}{W} \cdot 2 \cdot \pi\right) \cdot .057$ $y2_\theta := \sin\left(\frac{d2_\theta}{W} \cdot 2 \cdot \pi\right) \cdot .086$ $y3_\theta := \sin\left(\frac{d3_\theta}{W} \cdot 2 \cdot \pi\right) \cdot .140$ $y4_\theta := \sin\left(\frac{d4_\theta}{W} \cdot 2 \cdot \pi\right) \cdot .217$ $y5_\theta := \sin\left(\frac{d5_\theta}{W} \cdot 2 \cdot \pi\right) \cdot .314$ $y6_\theta := \sin\left(\frac{d6_\theta}{W} \cdot 2 \cdot \pi\right) \cdot .429$ $y7_\theta := \sin\left(\frac{d7_\theta}{W} \cdot 2 \cdot \pi\right) \cdot .543$ $y8_\theta := \sin\left(\frac{d8_\theta}{W} \cdot 2 \cdot \pi\right) \cdot .669$ $y9_\theta := \sin\left(\frac{d9_\theta}{W} \cdot 2 \cdot \pi\right) \cdot .777$ $y10_\theta := \sin\left(\frac{d10_\theta}{W} \cdot 2 \cdot \pi\right) \cdot .877$ $y11_\theta := \sin\left(\frac{d11_\theta}{W} \cdot 2 \cdot \pi\right) \cdot .949$ $y12_\theta := \sin\left(\frac{d12_\theta}{W} \cdot 2 \cdot \pi\right) \cdot .991$ $y13_\theta := \sin\left(\frac{d13_\theta}{W} \cdot 2 \cdot \pi\right) \cdot 1.00$ $y14_\theta := \sin\left(\frac{d14_\theta}{W} \cdot 2 \cdot \pi\right) \cdot .991$ $y15_\theta := \sin\left(\frac{d15_\theta}{W} \cdot 2 \cdot \pi\right) \cdot .949$ $y16_\theta := \sin\left(\frac{d16_\theta}{W} \cdot 2 \cdot \pi\right) \cdot .877$ $y17_\theta := \sin\left(\frac{d17_\theta}{W} \cdot 2 \cdot \pi\right) \cdot .777$ $y18_\theta := \sin\left(\frac{d18_\theta}{W} \cdot 2 \cdot \pi\right) \cdot .669$ $y19_\theta := \sin\left(\frac{d19_\theta}{W} \cdot 2 \cdot \pi\right) \cdot .543$ $y20_\theta := \sin\left(\frac{d20_\theta}{W} \cdot 2 \cdot \pi\right) \cdot .429$ $y21_\theta := \sin\left(\frac{d21_\theta}{W} \cdot 2 \cdot \pi\right) \cdot .314$ $y22_\theta := \sin\left(\frac{d22_\theta}{W} \cdot 2 \cdot \pi\right) \cdot .217$ $y23_\theta := \sin\left(\frac{d23_\theta}{W} \cdot 2 \cdot \pi\right) \cdot .140$ $y24_\theta := \sin\left(\frac{d24_\theta}{W} \cdot 2 \cdot \pi\right) \cdot .086$ $y25_\theta := \sin\left(\frac{d25_\theta}{W} \cdot 2 \cdot \pi\right) \cdot .057$ $$xs_\theta := x1_\theta + x2_\theta + x3_\theta + x4_\theta + x5_\theta + x6_\theta + x7_\theta + x8_\theta + x9_\theta + x10_\theta + x11_\theta + x12_\theta + x13_\theta + x14_\theta + x15_\theta + x16_\theta + x17_\theta + x18_\theta + x19_\theta \ldots + x20_\theta + x21_\theta + x22_\theta + x23_\theta + x24_\theta + x25_\theta$$

$$ys_\theta := y1_\theta + y2_\theta + y3_\theta + y4_\theta + y5_\theta + y6_\theta + y7_\theta + y8_\theta + y9_\theta + y10_\theta + y11_\theta + y12_\theta + y13_\theta + y14_\theta + y15_\theta + y16_\theta + y17_\theta + y18_\theta + y19_\theta \ldots + y20_\theta + y21_\theta + y22_\theta + y23_\theta + y24_\theta + y25_\theta$$

$\text{WRITE(xslow)} := xs1_\theta$ $\text{WRITE(yslow)} := ys1_\theta$ $xs1_\theta := \text{READ(xslow)}$ $ys1_\theta := \text{READ(yslow)}$ $$e_\theta := \sqrt{[(.5 \cdot xs1_\theta) + .5 \cdot xs_\theta]^2 + (.5 \cdot ys1_\theta + .5 \cdot ys_\theta)^2} \qquad edB_\theta := 20 \cdot \log\left(\frac{e_\theta}{13.27}\right)$$

TABLE E

| Microphone Array System Characteristics And Operating Margins | | |
|---|---|---|
| Sound level 3 feet from source, dB: | | Sls := 0 |
| Sound level at array center, dB, distance equals 53 feet: | $Sla := 20 \cdot \log\left(\frac{3}{53}\right)$ | Sls = −24.9 |
| Array gain (25 microphones), dB: | | Ga := 28 |
| Array output, dB: | Ao := Ga + Sla | Ao = 3.1 |
| Array attenuation at loud speaker angle, dB: (greater than 44 degrees from beam center) | | Asl := −47 |
| Sound level at listener, dB: | | Sll := −6 |
| Space attenuation, speaker-to-listener, dB: (3 foot reference from speaker to 70 foot distance) | $Als := 20 \cdot \log\left(\frac{3}{70}\right)$ | Als = −27.4 |
| Sound level 3 feet from speaker, dB: | Ssp := Sll − Als | Ssp = 21.4 |
| Amplification, array output to 3 ft. speaker refernce, dB: | Aa := Ssp − Ao | Aa = 18.3 |
| Space attenuation, speaker-to-array center, dB: (3 foot reference from speaker to 30 foot distance) | $Asa := 20 \cdot \log\left(\frac{3}{30}\right)$ | Asa = −20 |
| System feedback margin, dB: | Mf := Sls − Asa − Asl − Aa − Ga | Mf = 20.7 |

The invention provides, therefore, a unique beamed microphone array system which utilizes a linear end-fire array of microphone elements directed at the source of sound to be enhanced, and which represents an economical and practical system for enhancing the sound so that it can be distinctly heard throughout the auditorium or other facility without acoustic feedback. The microphone array system may also be used for recording at relatively large distances from the source.

While a particular embodiment of the invention has been shown and described, modifications may be made. Variation in beamwidth, sidelobe levels and frequency band are possible with changes in the number of elements in each sub-array, changes in the amplitude distribution and number of sub-arrays, as known to those skilled in the field of acoustic physics. It is intended in the claims to cover all such modifications which come within the true spirit and scope of the invention.

I claim:

1. A sound enhancement system comprising: a linear end-fire microphone array comprising a plurality of microphone elements disposed along the longitudinal axis of said array and having predetermined longitudinal spacings therebetween, said array being spaced from a sound source and having its longitudinal axis directed at the sound source, said array providing a narrow sound acceptance beam through the forward end thereof for acoustic pickup by said microphone elements of sounds emanating from the sound source with the center of said sound pickup beam extending from the forward end of said array along the longitudinal axis thereof; loudspeaker means; and processing circuit means connected to said microphone elements of said linear array and to said loudspeaker means for processing output signals from said microphone elements and introducing said output signals to said loudspeaker means, said processing circuit means including means for introducing predetermined time delays to said output signals to compensate for differences in distance and propagation delay from said sound source to different ones of said microphone elements so as to cause the signal phase from each of said microphone elements to be coincident at the center of said sound pickup beam.

2. The sound enhancement system defined in claim 1, in which said microphone elements in said linear array are grouped in a series of aligned sub-arrays each covering a different frequency range with the spacing between the microphone elements in each of said sub-arrays being the same, and with the spacing between said microphone elements in different ones of said sub-arrays being different.

3. The sound enhancement system defined in claim 2, in which the spacing between the microphone elements in successive ones of said sub-arrays increases in a progression $2^0$, $2^1$, $2^2$, $2^3$.

4. The sound enhancement system defined in claim 3, in which certain ones of said microphone elements are common to various ones of said sub-arrays.

5. The sound enhancement system defined in claim 3, in which said microphone elements are grouped in six sub-arrays covering frequency ranges of approximately 5 kHz–10 kHz; 2.5 kHz–5 kHz; 1250 Hz–2.5 kHz; 625 Hz–1250 Hz; 312 Hz–625 Hz; and 156 Hz–312 Hz respectively.

6. The sound enhancement system defined in claim 4, in which said microphone elements are grouped in six sub-arrays covering frequency ranges of approximately 5 kHz–10 kHz; 2.5 kHz–5 kHz; 1250 Hz–2.5 kHz; 625 Hz–1250 Hz; 312 Hz–625 Hz; and 156 Hz–312 Hz respectively.

7. The sound enhancement system defined in claim 6, in which there are a total of 85 microphone elements in six sub-arrays designated 1–85, and in which the microphone elements in the six sub-arrays are grouped in accordance with the following table:

Sub-Array Ranges and Microphone Elements

| Sub Array | Frequency Range | Microphone Elements |
|---|---|---|
| 1 | 5 kHz–10 kHz | 31.32.33.34 - - - 41.42.43.44.45.46 - - - 53.54.55 |
| 2 | 2.5 kHz–5 kHz | 25–31.33.35.37.39.41.43.45.47.49.51.53.55–61 |
| 3 | 1250 Hz–2.5 kHz | 19–25.27.29.31.35.39.43.47.51.55.57.59.61–67 |
| 4 | 625 Hz–1250 Hz | 13–19.21.23.27.31.35.43.51.57.61.63.65.67–73 |
| 5 | 312 Hz–625 Hz | 7–13.15.17.19.23.29.43.57.63.67.69.71.73–79 |
| 6 | 156 Hz–312 Hz | 1 - - - 7.9.11.13.17.23.43.63.69.73.75.77.79–85 |

8. The sound enhancement system defined in claim 2, in which said processing circuit means includes means for sampling output signals from each of said microphone elements; circuit means for digitizing the sampled output signals; a plurality of summing networks corresponding in number to the number of said sub-arrays; a corresponding plurality of digital/analog networks connected to respective ones of said summing networks; means connected to said digitizing means for selectively introducing digitized output signals from the microphone elements in each of said sub-arrays to respective ones of said summing networks; and output circuit means connected to said digital/analog network for producing an output signal for introduction to said loudspeaker.

9. The sound enhancement system defined in claim 2, in which said processing circuit means includes a plurality of sample-and-hold circuits corresponding in number to the number of said microphone elements and connected to respective ones of said microphone elements; analog/digital converter means; memory means connected to said analog/digital converter means; and microprocessor means for sampling the output signals from said microphone elements and storing the output signals in respective ones of said sample-and-hold circuits, and for selectively connecting the sample-and-hold circuits to said analog/digital converter means for storing digitized samples of the outputs of said microphone elements in each of said sub-arrays in selected memory locations in said memory means; a plurality of summing networks corresponding in number to the number of said sub-arrays, and a corresponding number of digital/analog converter circuits connected to respective ones of said summing networks, and in which said microprocessor means selects digital signals from said memory means corresponding to the output signals from said microphone elements in each of said sub-arrays and introduces said signals to respective ones of said summing networks.

10. The sound enhancement system defined in claim 9, and which band pass filter means interposed between each of said summing networks and a corresponding one or said digital/analog converter circuits for attenuating any frequency components above and below the frequency range covered by corresponding one of said sub-arrays to suppress acoustic feedback.

11. The sound enhancement system defined in claim 8, and which includes output amplifier means connected to said digital/analog converter means for producing an output signal for said loudspeaker.

12. The sound enhancement system defined in claim 9, in which said memory means introduces said predetermined time delays to the output signals from said microphone elements.

13. The sound enhancement system defined in claim 9, and which includes an amplitude distribution network interposed between said memory means and said summing networks to modify the amplitudes of the signals introduced to said summing networks in accordance with a Taylor or similar amplitude distribution factor to reduce substantially the sidelobe levels of the acceptance beam of said linear array.

* * * * *